US008550312B2

(12) United States Patent
Hefele

(10) Patent No.: US 8,550,312 B2
(45) Date of Patent: Oct. 8, 2013

(54) EXTRUSION DEVICE

(75) Inventor: Christian Hefele, Breitenbrunn (DE)

(73) Assignee: Hilti Aktiengesellschaft (LI)

( * ) Notice: Subject to any disclaimer, the term of this patent is extended or adjusted under 35 U.S.C. 154(b) by 0 days.

(21) Appl. No.: 13/396,348

(22) Filed: Feb. 14, 2012

(65) Prior Publication Data

US 2012/0223105 A1 Sep. 6, 2012

(30) Foreign Application Priority Data

Feb. 16, 2011 (DE) ..... 10 2011 004 254

(51) Int. Cl.
*B67D 7/60* (2010.01)

(52) U.S. Cl.
USPC ..... 222/392; 222/137

(58) Field of Classification Search
CPC ..... B05C 17/01
USPC ..... 222/192, 191, 326, 327, 386, 392, 391, 222/137–142, 145.5, 145.6
See application file for complete search history.

(56) References Cited

U.S. PATENT DOCUMENTS

| | | | | |
|---|---|---|---|---|
| 1,025,511 | A | 5/1912 | Craven | |
| 3,774,809 | A | 11/1973 | Bratton | |
| 4,865,229 | A * | 9/1989 | Schneider et al. | 222/325 |
| 5,853,774 | A * | 12/1998 | Dreve | 425/87 |
| 6,120,203 | A | 9/2000 | Modders | |
| 8,251,260 | B2 * | 8/2012 | Hung | 222/392 |
| 2009/0314809 | A1 * | 12/2009 | Lederle et al. | 222/392 |

OTHER PUBLICATIONS

EPO Communication, Jul. 3, 2012, 4 pages.

* cited by examiner

*Primary Examiner* — Lien Ngo
(74) *Attorney, Agent, or Firm* — McAndrews, Held & Malloy, Ltd.

(57) ABSTRACT

An extrusion device for extruding material from cartridges, having at least one plunger rod which can be moved, at least one bendable traction element which is coupled to the plunger rod(s) at attachment points, and having an advancement device which is coupled to the traction element between the attachment points and which actuates the movement of the plunger rod, wherein the advancement device has at least one driven rotating body, the traction element being wound around the same between its attachment points, and being driven by the same.

15 Claims, 3 Drawing Sheets

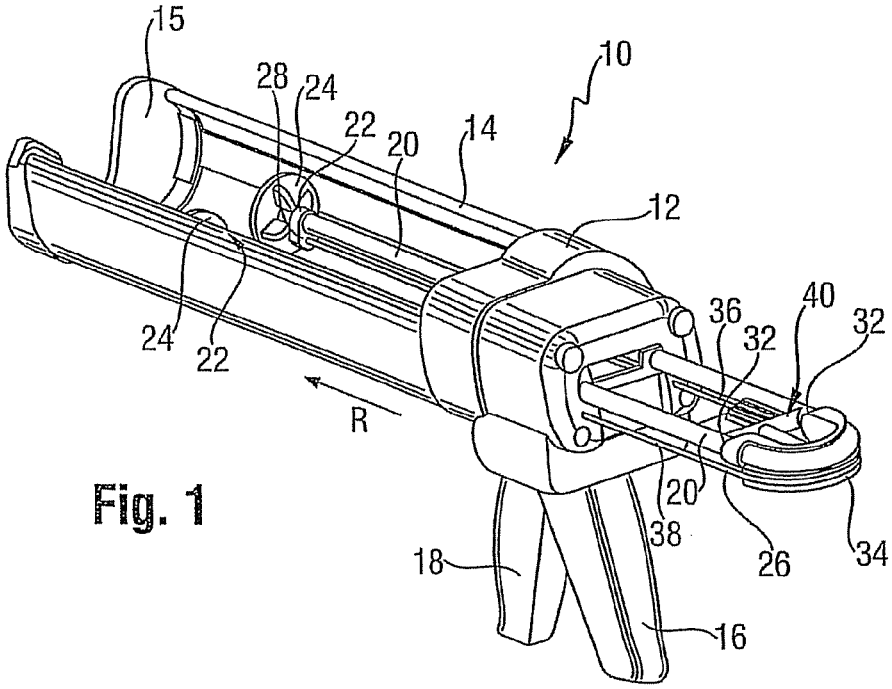
Fig. 1
Fig. 2
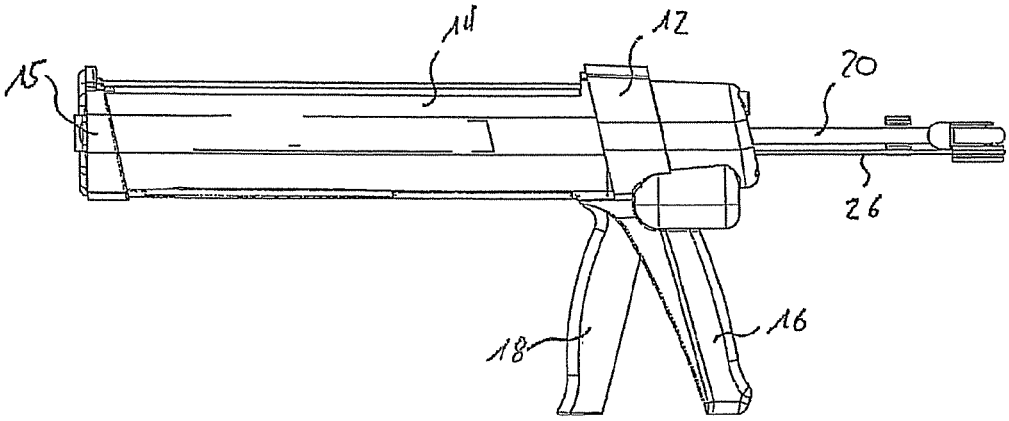

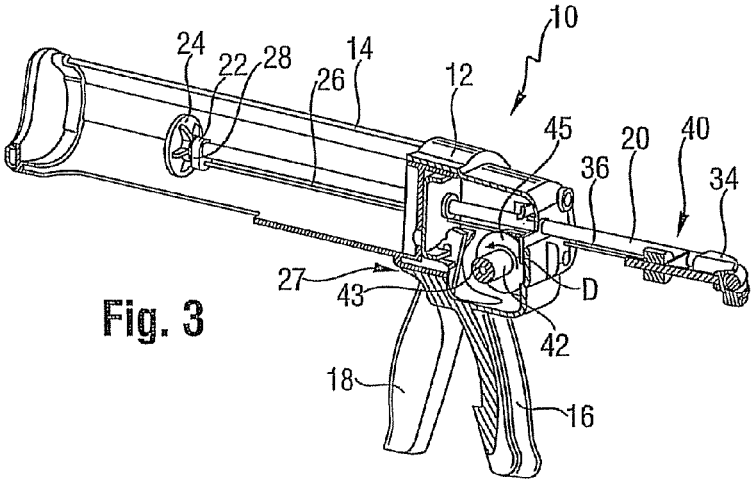
Fig. 3
Fig. 4
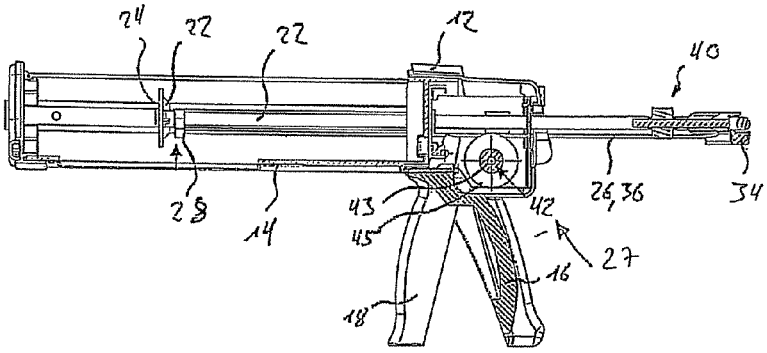
Fig. 5
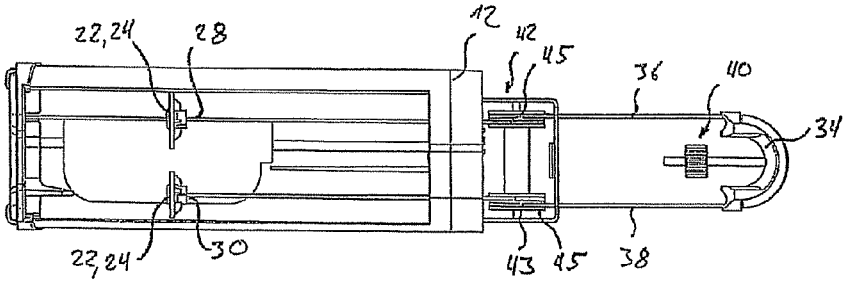

EXTRUSION DEVICE

CROSS-REFERENCE TO RELATED APPLICATIONS

The present application claims priority to German Patent Application DE 10 2011 004 254.7, filed Feb. 16, 2011, and entitled "Auspressgerat" ("Extrusion Device"), which is hereby incorporated by reference in its entirety.

BACKGROUND OF THE INVENTION

The present invention relates to an extrusion device for extruding material from cartridges, having at least one plunger rod which can be moved.

Such extrusion devices are used in construction applications, for example, for extruding material from cartridges which are filled with silicone or other liquid and/or semiliquid construction materials. These cartridges typically have a cylindrical body with a discharge opening arranged on one end wall. The opposite end wall is formed by a male element which can travel inside the cylindrical body, such that the volume of the cartridge can be modified using the movement of this end wall, and as a result the contents of the cartridge can be pressed out through the discharge opening. The extrusion device enables an exact dosing as well as the precise application of the construction material. The extrusion device typically has a plunger which is arranged on a plunger rod, said plunger abutting the male element of the cartridge and being able to move the same toward the discharge opening for the purpose of extruding the material in the cartridge. The extrusion device also has an advancement device which can engage on the plunger rod and compel the same in a direction of advancement.

Conventional extrusion devices have a clamp element which can cant on the plunger rod. The clamp element is canted on the plunger rod, and then moved in the direction of advancement, whereby the plunger rod moves in an extrusion direction, and the material in the cartridge is accordingly extruded. However, these advancement devices have the disadvantage that it is only possible to extrude the material in the cartridge in a step-wise manner, because in order to change the position of the clamp element on the plunger rod, the advancement device must be completely disengaged each time.

In the prior art, for the purpose of enabling a continuous extrusion process, extrusion devices are known which have a traction mechanism which is attached on one end thereof to an end of the plunger rod. On the opposite end thereof, the traction mechanism is coiled around a spool. The spool is driven using a continuous drive, for example by an electric motor, such that it is possible to extrude the material in the cartridge in a constant manner. Such an advancement mechanism, however, has the disadvantage that the traction mechanism must be stowed inside the housing and takes up more space when fully rolled up around the spool. In addition, with this coiling method, due to the expanding radius around the spool produced by the coiled part of the traction mechanism, the advancement movement is accelerated in the direction of extrusion, thereby extruding more material. In configurations wherein the traction mechanism is coiled in coil paths which are adjacent to each other, undesired shear forces are exerted on the plunger rod due to the changing skew of the traction mechanism. These shear forces can lead to a canting or deformation of the plunger rod.

BRIEF SUMMARY OF THE INVENTION

A problem addressed by one or more embodiments of the invention is that of providing an extrusion device for extruding material in cartridges, wherein the extrusion device enables reliable, even, and continuous extrusion of the material in a cartridge.

BRIEF DESCRIPTION OF THE DRAWINGS

Additional advantages and features are given in the following description with reference to the attached illustrations, wherein:

FIG. 1 shows a perspective view of an extrusion device according to one or more embodiments of the invention, FIG. 2 shows a side view of the extrusion device in FIG. 1, FIG. 3 shows a perspective partial sectional view of the extrusion device in FIG. 1, FIG. 4 shows a longitudinal sectional view of the extrusion device in FIG. 3, FIG. 5 shows a top view of the extrusion device in FIG. 1.

DETAILED DESCRIPTION OF THE INVENTION

Figure 6:
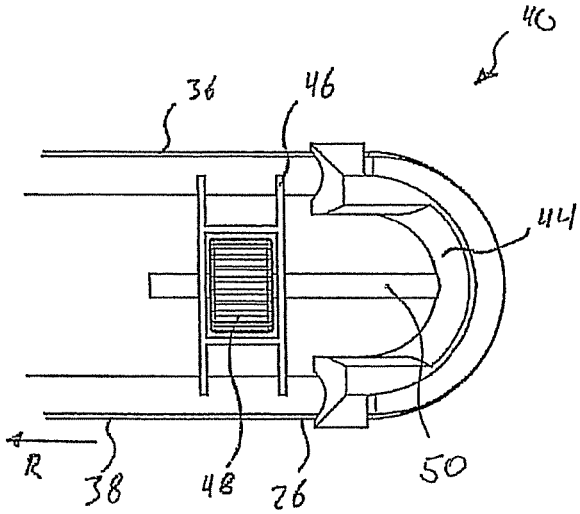
FIG. 6 shows a detail view of the tensioning mechanism of the extrusion device in FIG. 1.

One or more embodiments of the present invention provide an extrusion device for extruding the material in a cartridge, having at least one movable plunger rod, at least one bendable traction element which is coupled to the plunger rod or plunger rods on attachment points thereof, and having an advancement device which is coupled to the traction element between the attachment points and which actuates the movement of the plunger rod. The advancement device has at least one driven rotating body, and the traction element is wound around said rotating body between the attachment points thereof. The rotating body drives the traction device. Due to the winding, the traction mechanism is always partially wound around the rotating body at a constant angle of wrap. No shear forces are present, and the movement of the plunger rod is always constant.

The traction element is preferably tensioned between both attachment points, meaning around the rotating body, and the rotating body divides the traction element into two segments. The region between a first attachment point and the rotating body is defined as a first segment, and a second segment is defined as the region between the second attachment point and the rotating body. The traction element can be directly attached to the plunger rod, by way of example. However, a configuration can also be contemplated wherein an additional holding structure is provided which is coupled to the plunger rod. Due to the pretensioning, the traction element abuts the rotating body with an associated relatively high friction resistance. If the rotating body is rotating, the region of the traction element which abuts the rotating body is carried along with the motion due to the friction in play. According to the direction of the rotation of the rotating body, the traction element is drawn into either the first or the second segment as a result of the movement, wherein this drawing action moves the traction element in the direction toward the rotating body. At the same time, the traction mechanism is fed out on the other segment or segments of the rotating body. The traction element is therefore displaced in the longitudinal dimension by the rotating body, and the latter effectively functions as a traction sheave. The plunger element which is coupled to the traction element is displaced either in the advancement direction or in an opposite direction according to the direction in which the rotating body rotates, by each of the segments of the traction element drawn into the rotating body. As such, using this drive, the rotary movement of the rotating body is converted into a linear movement of the plunger rod. Using a continuous drive of the rotating body, one or more embodiments of the invention enable a continuous, i.e. uninterrupted, constant advancement of the plunger rod between the two attachment points. Because the rotating body only serves as a traction sheave which moves the traction element, and not as a spool, no structural space needs to be devoted to accommodating the traction element.

In the case of the known cable pull devices, the plunger rod had to be retracted by hand because the traction element was not able to transmit pressure forces. By reversing the direction of rotation, the direction of traction of the traction element is reversed, such that a movement of the plunger rod in the opposite direction of the advancement direction is also possible, for example for the purpose of removing the load on the cartridge once the extrusion process is completed or when the operator wishes to exchange the cartridges. For this purpose, the traction element is preferably tensioned over the entire length of the plunger rod, such that it is possible for traction to be transmitted over the entire length of the plunger rod, and also in both opposing directions.

In order to achieve sufficient friction between the traction element and the rotating body, the angle of wrap of the traction element around the rotating body is preferably at least 360°, and at most 720°.

The traction element preferably runs in sections substantially parallel to the plunger rod. Particularly in the regions abutting the attachment points, it is advantageous for the traction element to be routed in a parallel path, because in this way it is possible to direct the traction force into the plunger rod along a path which is substantially oriented in the longitudinal dimension of the plunger rod. In a configuration wherein the traction element would be routed at an angle with respect to the plunger rod, additional, undesired bending forces and/or shear forces would be exerted on the traction element as a result, and could lead to canting or deformation of the plunger rod.

In order to enable adjustment of the pretensioning of the traction element, and therefore of the friction present between the rotating body and the traction element, a tensioning mechanism for the traction mechanism is preferably included on the first and/or on the second attachment point, wherein said tensioning mechanism works on the traction element in the longitudinal dimension of the plunger rod. The tensioning mechanism can have a spring element or an adjusting screw, by way of example. A spring element offers the advantage that the pretensioning and, as such, the friction of the traction element on the rotating body can be kept constant, due to the constant function of the spring. An adjusting screw enables a manual adaptation of the pretensioning.

The extrusion device can have two plunger rods which are substantially parallel to each other, for example, wherein a common traction element is included in the configuration for both plunger rods.

The traction element can be tensioned between additional holding elements which connect the plunger rods to each other on the ends thereof, such that the traction element is arranged in the constructed space between the plunger rods and substantially parallel to the same. The traction element is preferably arranged in the middle between the plunger rods, such that an even transmission of the traction force to both of the plunger rods takes place. In this way, the configuration prevents the plunger rods from canting. In this case, it is possible to include a drive for both plunger rods using a rotating body.

However, a configuration can also be contemplated wherein an attachment point is included on each of the plunger rods. In this embodiment, the attachment points are included on one end of each of the two plunger rods, wherein the traction element is routed between the attachment points and to the opposite ends of the plunger rods. The traction element is therefore effectively double tensioned between the ends of the plunger rods. This has the advantage that each of the segments of the traction element can be routed along its respective plunger rod close to the same, such that it is possible for the pressure forces to be transmitted to the plunger rods substantially without eccentricity.

In this embodiment, a deflection device is included for the traction element on the ends of the plunger rods which are situated opposite the attachment points, such that it is possible to evenly distribute the pretensioning onto the entire traction element, for example when only one tensioning mechanism is included on one of the attachment points. However, the tensioning mechanism can be included on the deflection device.

The drive device can, by way of example, engage with one of these two segments. However, a configuration can also be contemplated wherein the drive device engages with both segments, such that it is possible to evenly direct the load to both segments of the traction element without including a deflection device. In particular, a common rotating body for both segments can be contemplated.

In a further embodiment, the extrusion device has two substantially parallel plunger rods, and a separate traction element is included on each of the plunger rods. The traction elements are therefore entirely separated from each other.

In this embodiment, it is also possible to include a common advancement device for both of the traction mechanisms, wherein the advancement device engages with both traction mechanisms.

In this embodiment, a common rotating body is included, and the traction elements are wound around the same. In this way, it is possible to drive both traction elements evenly, and consequently to advance both plunger rods evenly. In this way, it is possible to prevent the two plunger rods from canting against each other.

The attachment points are preferably situated on the ends of the traction element.

The advancement device has, by way of example, a drive which works manually or continuously. Particularly, the drive can be a motor which is driven electrically or pneumatically.

FIGS. 1 and 2 illustrate an extrusion device 10 for a cartridge which is filled with silicone or another construction material which is capable of flow. The construction material in this case can be filled directly into the cartridge or can also be stored in an additional pouch inside the cartridge.

Such a cartridge has a cylindrical body with a first end wall, the same having a discharge opening, and a second end wall disposed opposite the first, wherein the second end wall is formed by a movable male form. By moving this male form, the volume of the body is reduced, such that the construction material is pressed out through the discharge opening.

The extrusion device 10 has a housing 12 with a groove-shaped holder device 14, wherein a cartridge can be inserted into the same such that the cartridge is fixed in the extrusion device 10 in the direction of advancement R as well as in the direction transverse thereto. The discharge opening of the cartridge in this case abuts a front limit stop 15 of the holder device 14, while the opposite end wall, which is the movable male form, is arranged in such a manner that the plunger 24 of a plunger rod 20 can engage with the male form, as illustrated below, and thereby extrude the material in the cartridge. In addition, a hand grip 16 and an actuating lever 18 are included on the housing 12.

For the purpose of extruding the material in the cartridge, the extrusion device 10 has two plunger rods 20 which are substantially parallel (see FIG. 5) and which are mounted in the housing 12 to be able to move in the advancement direction R longitudinally.

The plunger rods 20 each have a plunger 24 on a first front end 22, wherein the same is defined with respect to the advancement direction R, and these plungers 24 can be guided against the male form of the cartridge. A traction element 26 is included for the purpose of guiding the plunger rods against the male form of the cartridge in the advancement direction R, and/or for the purpose of extruding the material in the cartridge. This traction element 26 is coupled to an advancement device 27 which is described in greater detail below.

The traction element 26 is a bendable steel cable, but the traction element can also be made of a different material which is resistant to tensile force but which can bend laterally. The traction element 26 is attached to an attachment point 28, 30 on each front end 22 of the plunger rods 20 (see also FIG. 5). The attachment points 28, 30 are preferably provided on the opposite ends of the traction element 26. A arch-shaped deflection device 34 is included on the opposite, rear ends 32 of the plunger rods 20, and this connects the plunger rods 20 and is routed around the traction device 26. In this way, the traction device 26 has two segments 36, 38 which run substantially parallel to each other, and each segment 36, 38, runs close along one of the plunger rods and parallel to the same. In addition, a tensioning mechanism 40 is provided on the deflection device 34, and is described in greater detail below.

As can be seen in FIGS. 3 and 4, the advancement device 27 has a rotating body 42 which can be rotated in the direction of rotation D and/or in the opposite direction. The rotating body has a shaft 43 and two disks 45 which are connected to the shaft in a fixed manner 43. One of the segments 36, 38 of the traction element 26 is wound around each of the disks 45 at an angle of 360°.

The rotating body 42 can be driven manually, but preferably a drive which operates continuously, for example an electric or pneumatic motor, is included. This is activated using the actuating lever 18. Optionally, an additional transmission mechanism can be provided which enables the direction of rotation of the rotating body 42 to be altered. Said transmission mechanism can be implemented as a suitable gearing between the motor and the rotating body 42.

In order to generate sufficient friction between the traction element 26 and the rotating body 42, the segments 36, 38 of the traction body 26 are each wound around the rotating body at a winding angle of 360°, and are pretensioned by the tensioning mechanism 40. The traction element 26 could also be wound multiple times around the rotating body 42, although the winding angle should not exceed 720°.

If the rotating body 42 is moved in the direction of rotation D, the same carries the traction element 26 along with the motion due to the friction fit between the traction element 26 and the rotating body 42, such that, figuratively speaking, the region of the traction element segments 36, 38 which faces toward the rear end 32 of the plunger rods can be drawn in, and the region which faces toward the front ends 22 can be fed out. The rotating body 42 therefore functions to a certain degree as a traction sheave which moves the traction device 26 in the advancement direction R. The plunger rods coupled to the traction element 26 are compelled in the advancement direction R as a result, and the material in the cartridge is extruded.

Because the traction element 26 is not wound around the rotating body 42, but rather the latter merely serves as a friction body by using which the traction element 26 is moved in the advancement direction R, no additional constructed space is required to receive the traction element 26. In the event that the extrusion process is interrupted or completed, the plunger rods also become fixed using the rotating body 42 and/or the traction element 26 which abuts the rotating body 42, such that no additional fixing mechanism is required. Such an additional fixing mechanism is required in extrusion devices having a drive which includes a clamp device, for example.

In addition, the plunger rod 20 can also be actively moved in the opposite direction by reversing the direction of rotation of the rotating body 42, for example in order to remove the load on the cartridge and thereby prevent the construction material from continuing to flow out.

Figure 7:
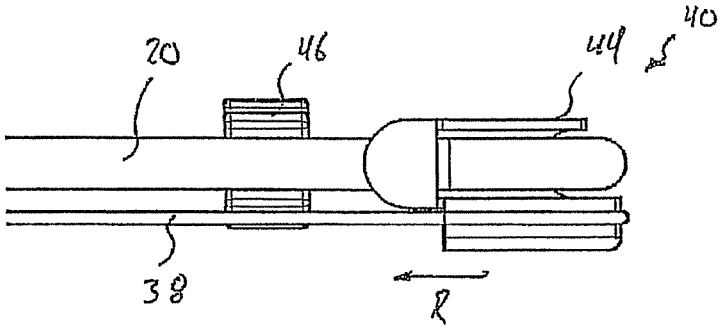
FIG. 7 shows a side view of the tensioning mechanism in FIG. 6.

The tensioning mechanism 40 is shown in a highly simplified illustration in FIG. 5, and in detail in FIGS. 6 and 7. The tensioning mechanism 40 has a deflection bow 44 which is mounted on the plunger rods 20 and can be moved in the direction of advancement R. The tensioning mechanism 40 also has a counter bearing 46 attached to the plunger rods 20, and an adjusting wheel 48 is mounted on the counter bearing 46. An adjusting screw 50 is attached on the deflection bow 44 and engages with a threading provided on the adjusting wheel 48. When the adjusting wheel 48 is rotated, the adjusting screw 50 is moved in the advancement direction. If the adjusting screw 50 is moved in the direction opposite the advancement direction R, the deflection bow 44 likewise moves in the same direction, and as a result the traction element 26 is pretensioned. When the opposite movement occurs, the load is removed from the traction element 26.

The tensioning mechanism could also have a spring element, wherein a constant pretensioning of the traction element 26 is provided by the same. This can be included in the configuration in addition to the adjusting screw 50. However, a configuration can also be contemplated wherein the tensioning screw is replaced by the spring element. The spring element is preferably arranged on an attachment point 28, 30 of the traction element 26. However, a configuration can also be contemplated wherein a tensioning mechanism 40, particularly a spring element, is provided on each of the attachment points 28, 30.

Instead of a common traction element 26 which is subdivided by the deflection device 34 into two segments 36, 38 running in parallel, a separate traction element 26 provided for each plunger rod 20 can also be contemplated. In this case, each of these traction elements 26 would replace one of the segments 36, 38 of the traction element 26. In other words each traction element 26 would be tensioned between the front end 22 and the rear end 32 of one plunger rod. Instead of the deflection device 34, in this case an attachment point 30 of the traction element 26 would be provided on the rear end 32 of each of the plunger rods 20, and a separate tensioning mechanism 40 would be provided for each traction element 26. In such an embodiment, a separate drive and/or a separate rotating body 42 could be provided for each traction element 26. A configuration can also be contemplated wherein two rotating bodies 42 are driven by a common drive, or a common rotating body 42 is provided for the two traction elements 26.

In a further embodiment, a common traction element 26 is provided for the two plunger rods 20, and said traction element 26 is tensioned between the front ends 22 and the rear ends 32 thereof. In this embodiment, the traction element 26 would not be directly attached to the plunger rods 20, but rather would be mounted between the plunger rods via an additional connector piece, such that it is possible to direct force evenly to both plunger rods 20. The traction element 26 is preferably arranged in the embodiment centrally in the constructed space between both plunger rods 20.

The drive of an extrusion device shown here, having a traction element 26, can also be realized as part of an extrusion device having only one plunger rod 20. The traction element 26 in this embodiment is preferably arranged as close as possible to the plunger rod 20, such that the tensile forces in play do not result in any bending forces being transmitted to the plunger rods 20, or only very minimal bending forces being transmitted to the plunger rods 20.

While particular elements, embodiments, and applications of the present invention have been shown and described, it is understood that the invention is not limited thereto because modifications may be made by those skilled in the art, particularly in light of the foregoing teaching. It is therefore contemplated by the appended claims to cover such modifications and incorporate those features which come within the spirit and scope of the invention.

The invention claimed is:

1. An extrusion device for extruding material from cartridges, said extrusion device including:

at least one plunger rod which is movable;

at least one bendable traction element which is coupled to the at least one plunger rod at a first attachment point and a second attachment point; and an advancement device which is coupled to the traction element between said first attachment point and said second attachment point and which actuates the movement of the plunger rod, wherein the advancement device has at least one driven rotating body, the traction element being wound around the at least one driven rotating body between said first attachment point and said second attachment point of said traction element, and being driven by the at least one driven rotating body.

2. An extrusion device according to claim 1, wherein the traction element has an angle of wrap around the rotating body of at least 360° and at most 720° .

3. An extrusion device according to claim 1, wherein the traction element runs in sections substantially parallel to the plunger rod.

4. An extrusion device according to claim 1, wherein a tensioning mechanism for the traction element is provided which acts on the traction element in the longitudinal dimension (L) of the plunger rod on a first and/or on a second attachment point.

5. An extrusion device according to claim 4, wherein the tensioning mechanism has a spring element or an adjusting screw.

6. An extrusion device according to claim 1, wherein the extrusion device has two plunger rods which are substantially parallel, and a common traction element is provided which is arranged inside the constructed space between the plunger rods.

7. An extrusion device according to claim 6, wherein an attachment point of the common traction element is provided on each plunger rod.

8. An extrusion device according to claim 7, wherein a deflection device for the traction element is provided on one end of the plunger rod.

9. An extrusion device according to claim 7, wherein the traction element has two segments which run substantially parallel, and the advancement device engages with each of the two segments.

10. An extrusion device according to claim 1, wherein the extrusion device has two plunger rods which are substantially parallel, and a traction element is provided on each of the plunger rods.

11. An extrusion device according to claim 10, wherein a common advancement device is provided which engages with each of the traction elements.

12. An extrusion device according to claim 11, wherein the advancement device has a drive.

13. An extrusion device according to claim 12, wherein said drive works manually.

14. An extrusion device according to claim 12, wherein said drive works continuously.

15. An extrusion device according to claim 12, wherein said drive is a motor which is driven by at least one of electrically and pneumatically.

* * * * *